US006311949B1

(12) United States Patent
Iida et al.

(10) Patent No.: US 6,311,949 B1
(45) Date of Patent: Nov. 6, 2001

(54) APPARATUS FOR OPERATING WATER GATE

(76) Inventors: Akio Iida, 373 Kou, Kasugai-cho, Higashiyamanashi-gun, Yamanashi (JP), 406-0014; Yoshio Iida, 2-3, Tokugyo 2-chome, Kofu-shi, Yamanashi (JP), 400-0047

( * ) Notice: Subject to any disclaimer, the term of this patent is extended or adjusted under 35 U.S.C. 154(b) by 0 days.

(21) Appl. No.: 09/581,401

(22) PCT Filed: Dec. 9, 1998

(86) PCT No.: PCT/JP98/05573

§ 371 Date: Jun. 12, 2000

§ 102(e) Date: Jun. 12, 2000

(87) PCT Pub. No.: WO99/29966

PCT Pub. Date: Jun. 17, 1999

(30) Foreign Application Priority Data

Dec. 11, 1997 (JP) ..... 9-341402
Nov. 10, 1998 (JP) ..... 10-318783

(51) Int. Cl.[7] ..... F16K 31/385; F16K 25/00; F16K 3/00; F16K 15/00

(52) U.S. Cl. ..... 251/61; 251/61.2; 251/326; 251/193; 137/510

(58) Field of Search ..... 251/61, 61.1, 61.2, 251/326, 193, 195; 137/494, 510

(56) References Cited

U.S. PATENT DOCUMENTS 3,931,953 * 1/1976 Allen ..... 251/62
3,933,338 * 1/1976 Herd et al. ..... 251/63.6
5,150,734 * 9/1992 Chiba ..... 137/567
5,492,534 * 2/1996 Athayde et al. ..... 604/141
5,875,813 * 3/1999 Cook ..... 137/362
5,992,819 * 11/1999 Asskildt et al. ..... 251/63.6

OTHER PUBLICATIONS

Microfilm of the specification and drawings annexed to the request of Japanese Utility Model Application No. 55–153639 (Laid–open No. 57–75021) (Hitachi Zosen Corp.), May 10, 1982, All drawings; Figs. 1, 2 (Family: none).

Microfilm of the specification and drawings annexed to the request of Japanese Utility Model Application No. 63–161079 (Laid–open No. 2–80143) (Marushima Sangyou K.K.), Jun. 20, 1990, Full text; Figs. 1 to 3 (Family: none).

* cited by examiner

*Primary Examiner*—Kevin Shaver
*Assistant Examiner*—D A Bonderer
(74) *Attorney, Agent, or Firm*—Wenderoth, Lind & Ponack, L.L.P.

(57) ABSTRACT

An apparatus for operating a water gate has a door of the water gate provided in a water channel, and has a mechanism for vertically operating the door. A pressure receiving plate is fixed to the door via an operating rod, and upper and lower air bags are provided on the upper and lower sides of the pressure receiving plate. An air compressor sends air into each of the upper and lower air bags, and a change-over valve and a flow rate regulating valve between the upper and lower air bags and the air compressor are adapted to switch and regulate the air sent into the upper and lower air bags. With this arrangement, compressed air is sent into the air bags to move the pressure receiving plate, vertically move the door and open and close the door. This apparatus is, moreover, adapted to drive the operating rod using the pressure of the air sent into the air bags, so that it has become possible to simplify the structure greatly.

22 Claims, 11 Drawing Sheets

APPARATUS FOR OPERATING WATER GATE

TECHNICAL FIELD

The present invention relates to an apparatus for a water gate which is adapted to open and close a small water gate of water gates for stopping and running flowing water in rivers and irrigation canals.

BACKGROUND ART

Recent apparatuses for operating a small water gate are of various types such as, A) a type in which threads are cut on an operating rod, and a female screw fitted on the operating rod is turned by a drive mechanism, by which the operating rod is moved upward or downward, B) a type in which an operating rod is formed into a rack formed integrally by two steel bars having a rectangular cross section and a large number of pins connecting these two steel bars to each other, and a gear engaging with the rack is turned by a drive mechanism, by which the operating rod is moved upward or downward, and C) a type in which an operating rod is connected to a piston of a reciprocating hydraulic jack, and the sucking and discharging operations of hydraulic oil are performed, by which the operating rod is moved upward or downward. Therefore, various kinds of apparatuses have been put to practical use.

However, these types of conventional apparatuses for operating a water gate not only are complicated in structure and high in equipment cost but also require much time and cost in daily check, lubrication, etc., which leads to a heavy burden on the installer.

Also, lubricating oil and hydraulic oil on a screw face and at parts of the mechanism drop into the water and contaminate the environment, which causes a bad reputation for the inhabitants of the neighborhood.

Further, the hydraulic jack type of item C) has a drawback in that the hydraulic jack becomes extremely expensive with an increase in the travel distance of operating rod.

In addition, when a door is lowered by gravity for the need of control, a further complicated mechanism must be added to perform speed control, which presents a problem of higher equipment cost.

The present invention has been made to solve the above problems with the conventional apparatus. Accordingly, an object thereof is to provide an apparatus for operating a water gate, in which air, which is inexpensive and has no fear of contaminating the environment, is used. Moreover, an operating rod is driven by the pressure of the air sent into air bags not by a conventional mechanism of air jack, so that it is possible to simplify the construction of the apparatus greatly.

SUMMARY OF THE INVENTION

To achieve the above object, the present invention provides an apparatus for operating a water gate, having a door of the water gate provided in a water channel to run and stop water and means for vertically operating the door. The apparatus comprises: a pressure receiving plate fixed to the door via an operating rod; a guide portion for guiding the vertical movement of the pressure receiving plate; upper and lower air bags provided on the upper and lower sides of the pressure receiving plate, respectively; an air compressor for sending air into each of the upper and lower air bags; and a change-over valve and a flow rate regulating valve which are provided between the upper and lower air bags and the air compressor and which are adapted to switch and regulate the air sent into the upper and lower air bags. Compressed air is sent into either of the air bags to move the pressure receiving plate so as to move the door vertically, whereby the door is opened or closed.

Also, the present invention provides an apparatus for operating a water gate, having a door of the water gate provided in a water channel to run and stop water and means for vertically operating the door. The apparatus comprises: a pressure receiving plate fixed to the door via an operating rod; a guide portion for guiding the vertical movement of the pressure receiving plate; upper and lower air bags provided on the upper and lower sides of the pressure receiving plate, respectively; an air compressor for sending air into each of the upper and lower air bags through an air feed pipe and a flow rate regulating valve; a discharging flow rate regulating valve for discharging air from the upper and lower air bags; and a four-way change-over valve which is provided between the upper and lower air bags and the air compressor, flow rate regulating valve, and discharging flow rate regulating valve and which is adapted to switch the air sent into the upper and lower air bags. Compressed air is sent into the lower air bag using the air compressor by operating the four-way change-over valve to move the pressure receiving plate, whereby the door is raised. Compressed air is sent into the upper air bag by switching the four-way change-over valve to move the pressure receiving plate, whereby the door is lowered. The four-way change-over valve is set at a neutral position, and a shutoff valve provided in an air feed pipe for the lower air bag is closed, whereby the door is held at a predetermined position. Thus, the door is opened or closed.

In the apparatus for operating a water gate in accordance with the present invention, each of the upper and lower air bags provided on the upper and lower sides of the pressure receiving plate consists of a plurality of unit bags. The unit bags are stacked by interposing and bonding a shape holding plate between the unit bags, and unit bags are connected to each other by an air hole, whereby the shape holding performance of air bag is improved.

In the apparatus for operating a water gate in accordance with the present invention, the upper air bag provided on the upper side of the pressure receiving plate is reinforced by a reinforcing rib so that the transverse shape thereof is not deformed greatly by a negative pressure. A manual valve for suction provided with an air intake portion is connected to the upper air bag through an air feed pipe with a large diameter.

In the apparatus for operating a water gate in accordance with the present invention, the upper air bag provided on the upper side of the pressure receiving plate is reinforced by a reinforcing rib so that the transverse shape thereof is not deformed greatly by a negative pressure. The upper and lower air bags are connected to each other by a bypass-pipe having a flow rate regulating valve and a shutoff valve at intermediate positions.

In the apparatus for operating a water gate in accordance with the present invention, a pin is inserted in the operating rod for connecting the door to the pressure receiving plate to support the pin at a predetermined position of an operating rod guide portion. The shutoff valve provided in the air feed pipe for the lower air bag is closed to hold the door so as to prevent the door from lowering under gravity.

When the door is to be lowered by gravity, the four-way change-over valve is set at a door lowering position, the pin is pulled out of the operating rod, the manual valve for suction is opened, and then the shutoff valve provided in the air feed pipe for the lower air bag is opened to lower the door by gravity.

In the apparatus for operating a water gate in accordance with the present invention, a pin is inserted in the operating rod for connecting the door to the pressure receiving plate to support the pin at a predetermined position of an operating rod guide portion. The shutoff valve provided in the air feed pipe for the lower air bag is closed to hold the door so as to prevent the door from lowering under gravity. When the door is to be lowered by gravity, the pin is pulled out of the operating rod, and the shutoff valve in the bypass pipe is opened.

In the apparatus for operating a water gate in accordance with the present invention, by sufficiently enlarging the area of the pressure receiving plate, the pressure of compressed air used is set at about 1 kgf/cm$^2$ or lower, whereby a change in volume of compressed air caused by a change in pressure is made as small as possible.

In the apparatus for operating a water gate in accordance with the present invention, the air compressor is additionally provided with a tank, and compressed air stored in the tank by the air compressor is used to perform operations in an emergency.

Conventionally, in an apparatus for operating a water gate, the operating load is liable to fluctuate, and the range of fluctuation is great. Moreover, it is required that the operating speed be as low as 0.1 to 3 m per minute, and the movement of the water gate be smooth. Specifically, the conventional apparatus features a great fluctuation range of operating load. In addition, if the load on an air cylinder or the like driven by compressed air fluctuates, there occurs a phenomenon that a drive mechanism stops or moves excessively, which has been believed to present danger.

That is to say, it has been judged that a gas whose volume changes greatly with a change in pressure, such as air, is unsuitable as a medium for transmitting a force of the apparatus for operating a water gate.

However, if the area of the pressure receiving plate is sufficiently enlarged so that the maximum pressure of compressed air used is made extremely low, a change in pressure due to a change in load becomes very small so that a change in volume also becomes very small. Thus, the operation state becomes stable, and a state that is approximately equal to the state of an apparatus using a liquid as the medium is established.

Specifically, a phenomenon that the operating rod moves or stops is less liable to take place. Even when the operating rod moves again after stopping once due to a fluctuation in load, the travel distance thereof is small and the travel speed thereof is low, so that there is no fear of danger.

Further, when compressed air is introduced into the construction of a conventional air cylinder to generate a force, not only a high airtightness required between the cylinder and piston or piston rod increases the cost of the air cylinder, but also the frictional force of a portion where slides while keeping airtightness is great, so that such configuration is unsuitable for the drive using compressed air with a low pressure.

To solve this problem, in the present invention, compressed air with a low pressure is put in an air bag, which is used to move the pressure receiving plate covering a large area by applying a force thereon, thereby moving the door of the water gate. Therefore, airtightness is not required between the operating rod and a support for supporting the sliding motion thereof and between the pressure receiving plate and a guide portion thereof, so that the frictional force of each sliding portion becomes very small.

Thus, by the use of compressed air in the apparatus for operating a water gate, which has been believed to be impossible before, the following problems with the conventional apparatus can be solved.

a) The mechanism is complicated and expensive.

b) The check and maintenance are difficult to do and require high cost.

c) Fats and oils contaminate the environment.

That is to say, air, which can be used freely at no cost, is used, and the mechanism of each part is simple and requires low machining accuracy, so that an inexpensive apparatus for operating a water elate can be provided. Also, there can be provided an apparatus for operating a water gate in which the check and maintenance are easy and even if the air leaks, there is no fear of contaminating the environment.

Therefore, the present invention can provide an apparatus for operating a water gate in which the construction is simple and inexpensive, and the handling, check, maintenance, repair, etc. are easy.

In addition, the air used by the apparatus for operating a water gate in accordance with the present invention is the environment itself and does not contaminate the environment. Thus, there is no fear of adverse effects on the environment caused by the apparatus itself.

DETAILED DESCRIPTION OF THE INVENTION

Embodiments of an apparatus for operating a water gate in accordance with the present invention will now be described in detail with reference to the accompanying drawings.

Figure 1:
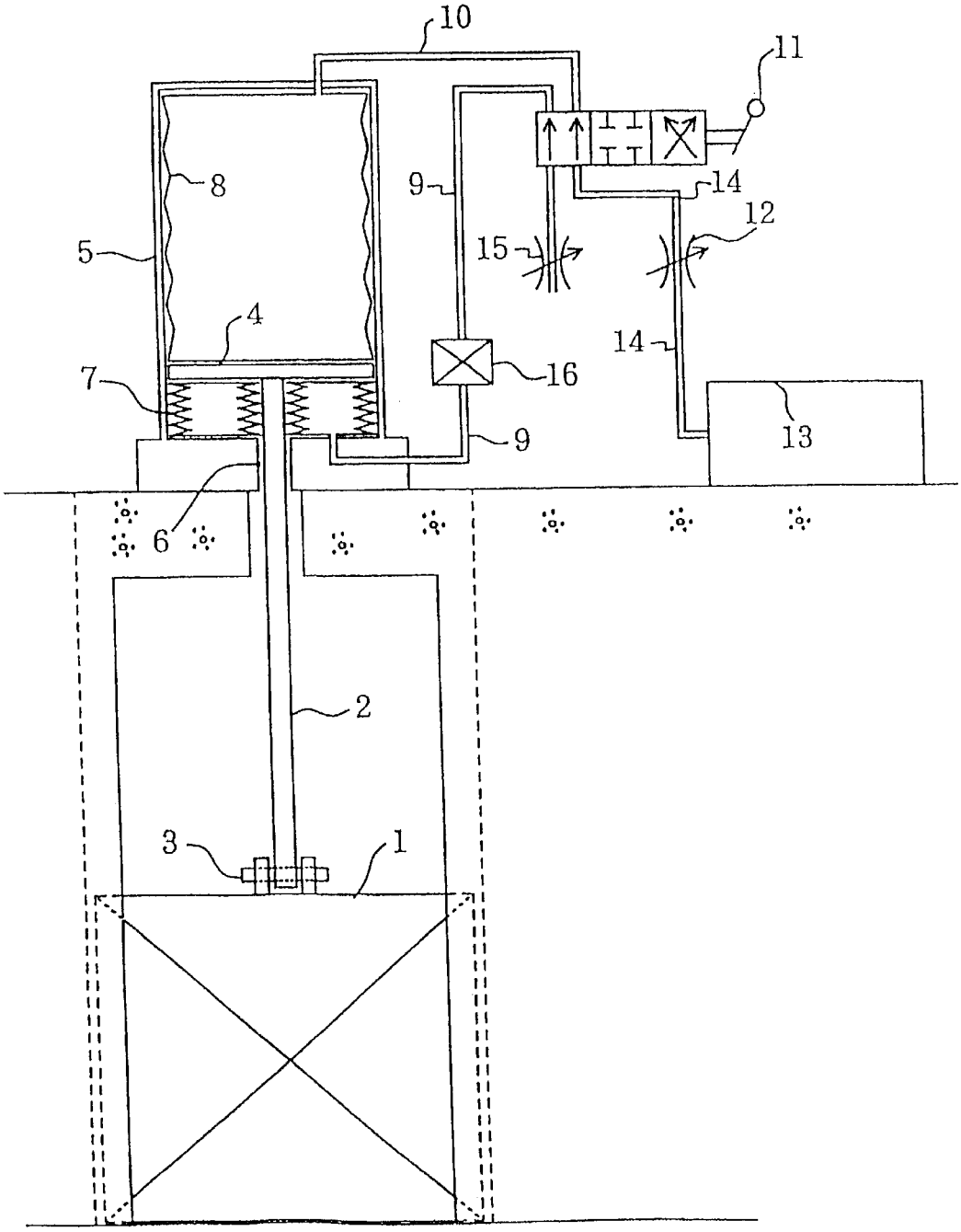
FIG. 1 is a schematic front view showing one embodiment of an apparatus for operating a water gate in accordance with the present invention, showing a state in which a door is lowered.
Figure 2:
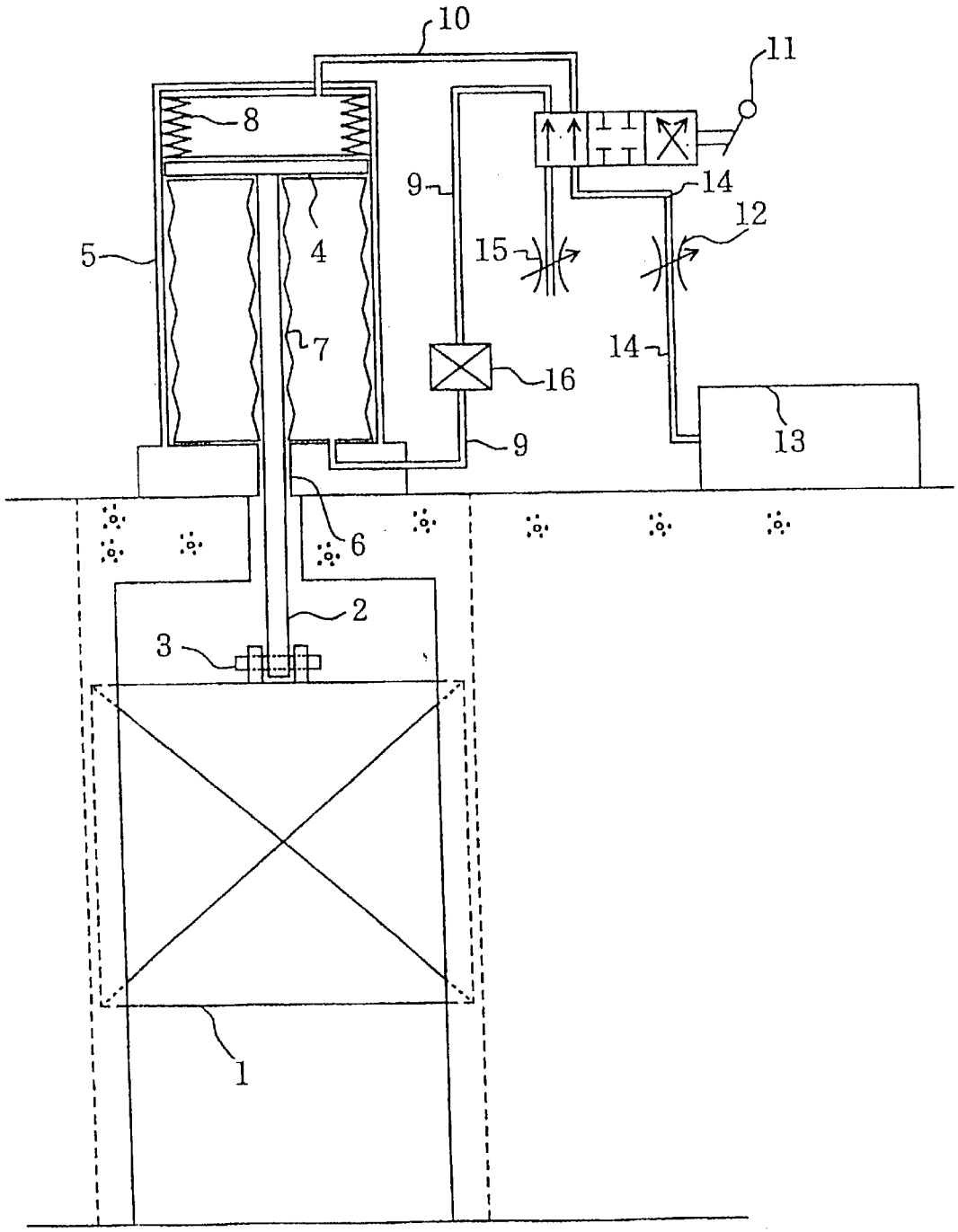
FIG. 2 is a schematic front view showing a state in which a door is raised.

FIGS. 1 and 2 show one embodiment of an apparatus for operating a water gate in accordance with the present invention.

In FIGS. 1 and 2, an operating rod 2 for pulling up and pushing down a door 1 of the water gate is connected to the door 1 via a pin 3. The upper part of the operating rod 2 extends into a case 5, and a pressure receiving plate 4 is attached to the upper end thereof. On the lower side of the pressure receiving plate 4 is provided a cylindrical lower air bag 7, which is connected to a four-way change-over valve 11 through a manual shutoff valve 16 by an air feed pipe 9. On the other hand, on the upper side of the pressure receiving plate 4 is provided a columnar upper air bag 8, which is connected to the four-way change-over valve 11 by an air feed pipe 10.

In addition, to the opposite side of the four-way change-over valve 11, an air compressor 13 is connected through a flow rate regulating valve 12 by an air feed pipe 14, and also a discharging flow rate regulating valve 15 is connected separately.

The four-way change-over valve 11 can select one of the following three positions:

(1) A position at which the air feed pipe 9 is connected to the discharging flow rate regulating valve 15, and at the same time, the air feed pipe 10 is connected to the air compressor 13 through the flow rate regulating valve 12 by the air feed pipe 14.

(2) A position at which four connection ports are closed.

(3) A position at which the air feed pipe 9 is connected to the air compressor 13 through the flow regulating valve 12 by the air feed pipe 14, and at the same time, the air feed pipe 10 is connected to the discharging flow rate regulating valve 15.

By making this selection of position, the raising, stopping, and lowering operations of the door 1 of the water gate are performed.

The pressure receiving plate preferably has a sufficiently enlarged area to keep the maximum working pressure low. In this case, a phenomenon that the operating rod 2 is stopped or moved according to a fluctuation in load is less liable to take place, and even if such a phenomenon takes place, sudden movement of the operating rod 2 can be prevented.

The calculations of the area and possible operating load of the pressure receiving plate, for example, at the time when the maximum pressure of air is assumed to be 0.5 kgf/cm$^2$ are made on a trial basis, and the following values can be obtained.

When the diameter of pressure receiving plate is 300 mm, Area=706 cm$^2$, Operating load=353 kgf When the diameter of pressure receiving plate is 500 mm, Area=1963 cm$^2$, Operating load=982 kgf When the diameter of pressure receiving plate is 800 mm, Area=5026 cm$^2$, Operating load=2513 kgf When the diameter of pressure receiving plate is 1000 mm, Area=7854 cm$^2$, Operating load=3927 kgf Therefore, this pressure receiving plate can be put to practical use for the apparatus for operating a water gate.

FIG. 1 shows a state in which compressed air is sent into the upper air bag 8 by means of the air feed pipe 14 and the air feed pipe 10 while the flow rate is controlled by the flow rate regulating valve 12 by setting the fourway change-over valve 11 at the position of (1) while the air compressor 13 is operated. At the same time, the air in the lower air bag 7 is discharged into the atmosphere through the opened manual shutoff valve 16 by the air feed pipe 9 while the flow rate is controlled by the discharging flow rate regulating valve 15. As a result, that the door 1, operating rod 2, pin 3, and pressure receiving plate 4 are lowered while the speed thereof is controlled.

FIG. 2 shows a state in which compressed air is sent into the lower air bag 7 through the opened manual shutoff valve 16 by the air feed pipe 14 and the air feed pipe 9 while the flow rate is controlled by the flow rate regulating valve 12 by setting the four-way change-over valve 11 at the position of (3). At the same time, the air in the upper air bag 8 is discharged into the atmosphere through the air feed pipe 10 while the flow rate is controlled by the discharging flow rate regulating valve 15. As a result, the door 1, operating rod 2, pin 3, and pressure receiving plate 4 are raised while the speed thereof is controlled.

When the four-way change-over valve 11 is set at the position of (3) in this state, the flow of air passing through the four-way change-over valve 11 is stopped, so that the door 1 etc. remain stationary.

However, in the case where the lower air bag 7 supports the weight of the door 1, operating rod 2, pin 3, and pressure receiving plate 4 as in this embodiment, the door 1 etc. gradually lowers undesirably if the air in the lower air bag 7 leaks. Therefore, when the door 1 etc. are kept still for a long period of time, the manual shutoff valve 16 is completely closed to keep the air leakage as small as possible.

Figure 3:
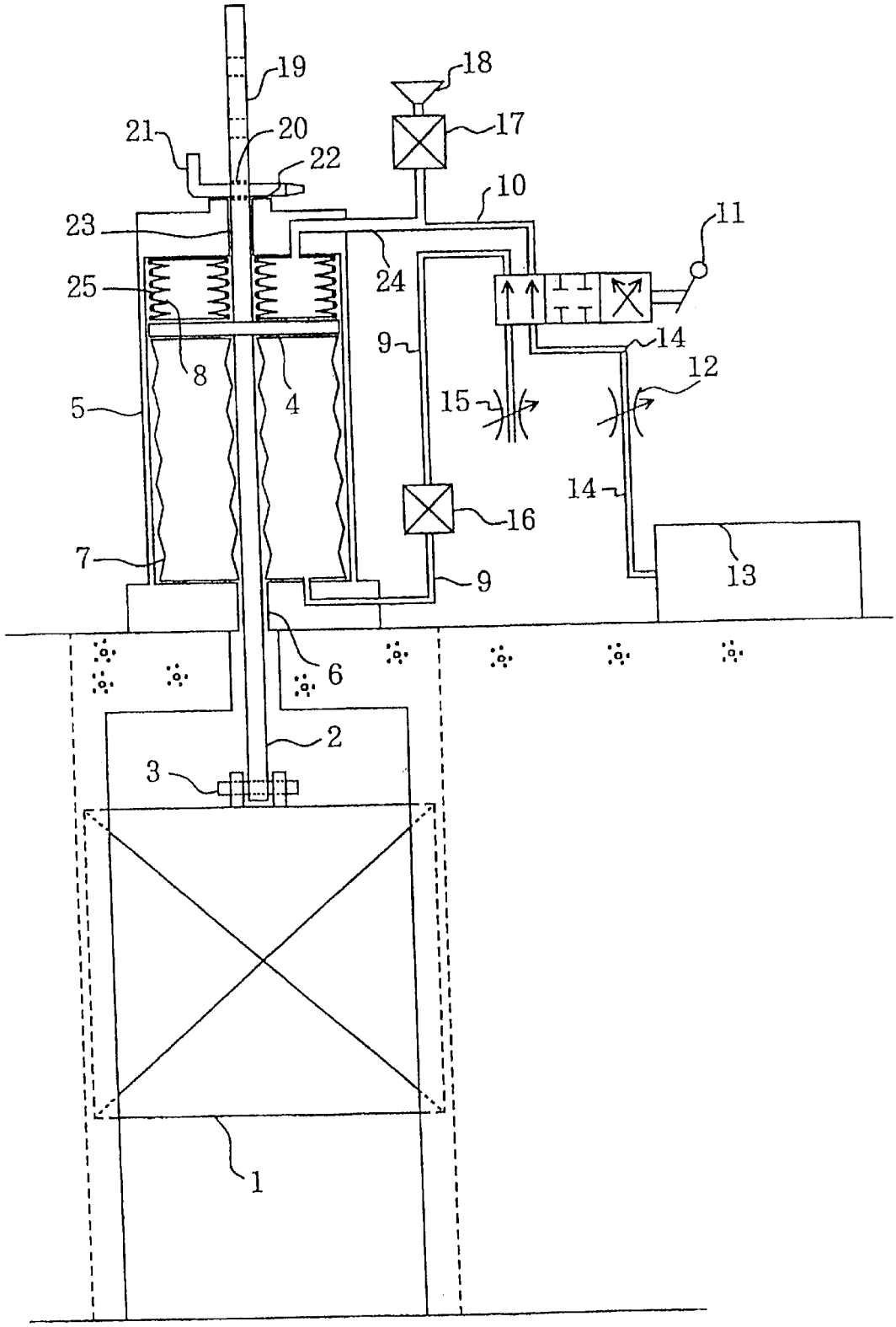
FIG. 3, is a schematic front view showing another embodiment of an apparatus for operating a water gate in accordance with the present invention, the apparatus including a pin for inhibiting the lowering of a door and an operating rod extension having holes for accommodating the pin, showing a state in which the door is raised, and the pin is inserted into the hole in the operating rod extension to inhibit the lowering of the door.
Figure 4:
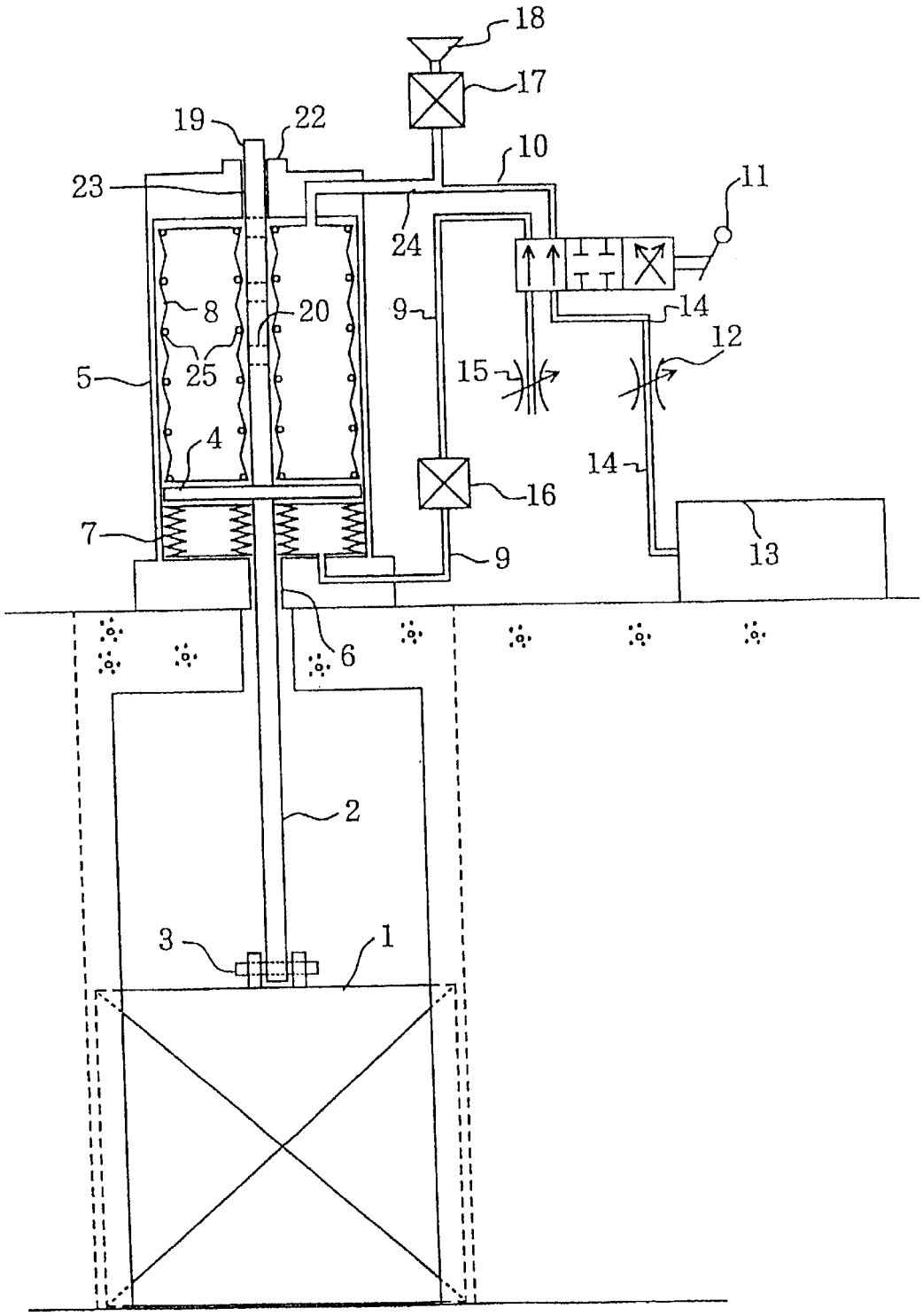
FIG. 4 is a schematic front view showing a state in which the door is dropped by gravity together with the operating rod by pulling out the pin in the embodiment shown in FIG. 3.

FIGS. 3 and 4 show another embodiment in which advanced consideration is further given to this problem of air leakage.

In FIGS. 3 and 4, the operating rod 2 for pulling up and pushing down the door 1 of the water gate is connected to the door 1 via pin 3. The upper part of the operating rod 2 extends into the case 5 by being supported by a guide portion 6 at the lower part of the case 5, and is fitted with the pressure receiving plate 4. An operating rod extension 19 is fixed to the upper part of the pressure receiving plate 4, and penetrates the upper part of the case 5 by being supported by a guide portion 23 at the upper part of the case 5.

The operating rod extension 19 is formed with a plurality of pin holes 20. When a pin 21 inserted in this pin hole 20 is supported on a support portion 22 at the upper part of the case 5, the door 1, operating rod 2, pin 3, pressure receiving plate 4, and operation rod extension 19 are prevented from lowering under gravity.

On the lower side of the pressure receiving plate 4 there is provided with the cylindrical lower air bag 7, which is connected to the four-way change-over valve 11 through the manual shutoff valve 16 by the air feed pipe 9. On the other hand, on the upper side of the pressure receiving plate 4 is provided with a cylindrical upper air bag 8 having a reinforcing rib 25 for keeping the outside and inside diameters thereof. The upper air bag 8 is connected to an air intake portion 18 through a manual shutoff valve 17 by an air feed pipe 24, and at the same time is connected to the four-way change-over valve 11 by the air feed pipe 10 branching off from the air feed pipe 24.

In addition, to the opposite side of the four-way change-over valve 11, the air compressor 13 is connected through the flow rate regulating valve 12 by the air feed pipe 14, and the discharging flow rate regulating valve 15 is also connected.

If the manual shutoff valve 16 is fully opened and the manual shutoff valve 17 is completely closed in the above-described configuration, the raising, lowering, and stopping operations of the door 1 can be performed by selecting one of the three positions of the four-way change-over valve 11, as in the case of the embodiment shown in FIGS. 1 and 2.

FIG. 3 shows a state in which compressed air is sent into the lower air bag 7 from the air compressor 13 through the air feed pipe 9 and the manual shutoff valve 16 while the flow rate is controlled by the flow rate regulating valve 12 by setting the four-way change-over valve 11 at the position of (3). At the same time, the air in the upper air bag 8 is discharged into the atmosphere through the air feed pipe 24 and the air feed pipe 10 while the flow rate is controlled by the discharging flow rate regulating valve 15. As a result, the pressure receiving plate 4 is subjected to a force from the lower air bag 7, by which the pressure receiving plate 4, operating rod extension 19, operating rod 2, pin 3, and door 1 are raised. FIG. 3 also shows a state in which the pin 21 is succeedingly inserted into one of the pin holes 20 in the operating rod extension 19 so that the pin 21 is supported on the support portion 22 at the upper part of the case 5, by which the lowering of the door 1 etc. is inhibited.

In this state, even if air leaks from the lower air bag 7, there is no fear that the door 1 etc. will lower.

FIG. 4 shows a state in which after the pin 21 is pulled out of the pin hole 20 in the operating rod extension 19 so that the door 1 etc. can lower in the state shown in FIG. 3, the door 1 etc. are lowered.

In order to lower the door 1 etc. in the state in which the pin 21 is pulled out, a method can be used in which compressed air is sent from the air compressor 13 by setting the four-way change-over valve 11 at the position of (1). However, the door 1 etc. can be lowered by gravity without using compressed air. In this case, after the weight of the door 1 etc. is supported by the pressure of air in the lower air bag 7 via the pressure receiving plate 4 by completely closing the manual shutoff valve 16 once, the pin 21 is pulled out of the pin hole 20 in the operating rod extension 19, the four-way change-over valve 11 is set at the position of (1), and succeedingly the manual shutoff valve 17 is fully opened. Then, the manual shutoff valve 16 is opened gently, so that the door 1 etc. will lower under gravity while the speed thereof is controlled by the discharging flow rate regulating valve 15.

In other words, the air in the lower air bag 7 that supports the weight of the door 1 etc. via the pressure receiving plate 4 is discharged into the atmosphere through the air feed pipe 9 and the manual shutoff valve 16 while the flow rate is controlled by the discharging flow rate regulating valve 15.

On the other hand, since the inner part of the upper air bag 8 is at a negative pressure, air is sucked in from the air intake portion 18 through the manual shutoff valve 17 and the air feed pipe 24. To reduce the resistance at this time, the diameters of the air feed pipe 24, the manual shutoff valve 17, etc. are extended, and the length of pipe is shortened.

Also, since there is a fear that the upper air bag 8 gets out of shape due to the negative pressure, the cylindrical shape is maintained by the reinforcing rib 25.

Figure 5:
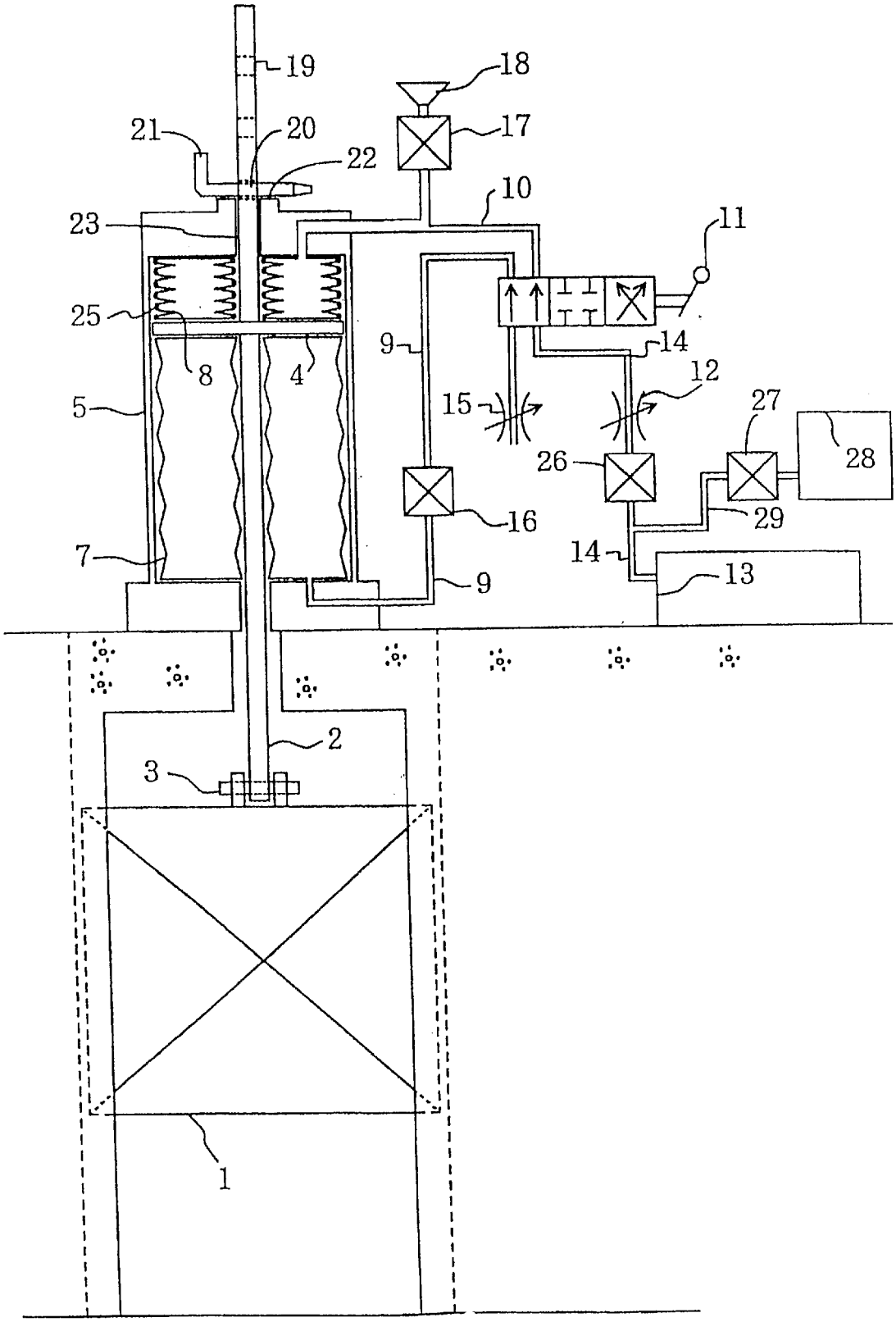
FIG. 5 is a schematic front view showing still another embodiment of an apparatus for operating a water gate in accordance with the present invention, showing a state in which an emergency tank is added in the embodiment shown in FIG. 3.
Figure 6:
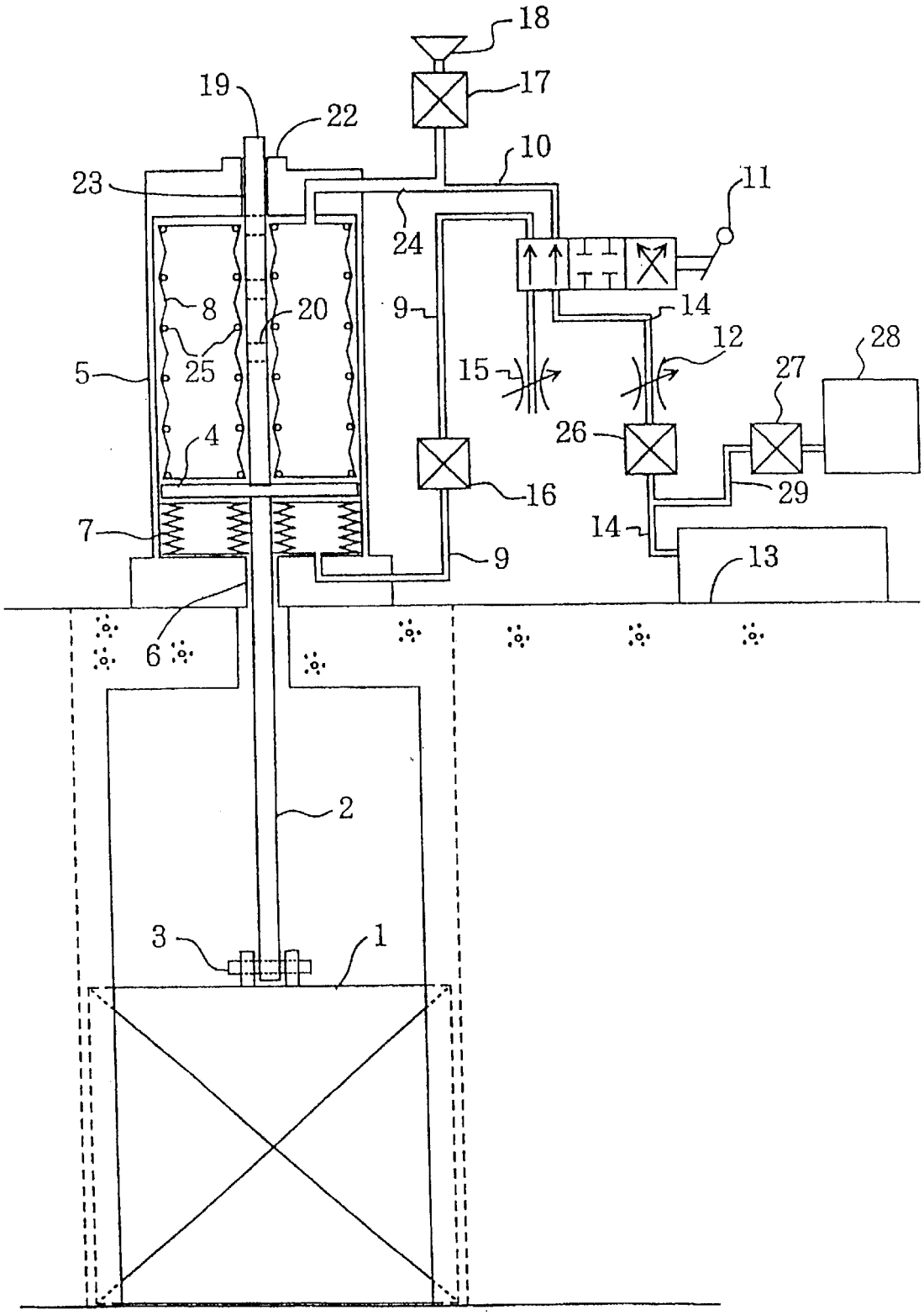
FIG. 6 is a schematic front view showing a state in which an emergency tank is added in the embodiment shown in FIG. 4.

FIGS. 5 and 6 show a case where compressed air stored in a compressed air tank 28 is used as a power source for emergency in the embodiment shown in FIGS. 3 and 4.

When a manual shutoff valve 26 is closed and a manual shutoff valve 27 is opened, and the air compressor 13 is operated, compressed air can be stored in the tank 28. Thereafter, the manual shutoff valve 27 is closed and the manual shutoff valve 26 is opened, by which the apparatus can be operated normally.

FIG. 5 shows, like FIG. 3, a state in which the weight of the raised door 1 etc. is supported by inserting the pin 21 into the hole 20 in the operating rod extension 19 so that the pin 21 is supported on the support portion 22 at the upper end of the case 5, whereby the lowering of the door 1, operating rod 2, etc. under gravity is inhibited. When the door 1 etc. are desired to be lowered in this state, the pin 21 must be pulled out. However, when a force applied between the support portion 22 and the pin 22 is great, it is difficult to pull out the pin 21. Therefore, the door 1 etc. must be pushed up slightly. At this time, there is no problem when the air compressor 13 is started smoothly, but if an emergency such as a failure of air compressor arises, the compressed air stored in the tank 28 is used.

In this case, after the manual shutoff valve 16 is opened and the four-way change-over valve 11 is set at the position of (3), the manual shutoff valve 27 is opened. Thereupon, the compressed air flows into the lower air bag 7, by which the door 1 etc. can be raised.

Subsequently, the manual shutoff valve 16 and the manual shutoff valve 27 are closed, and succeedingly the pin 21 is pulled out. Then, the four-way change-over valve 11 is set at the position of (1), and finally the manual shutoff valve 16 is opened, by which the door 1 etc. can be lowered by gravity.

FIG. 6 shows a state in which the door 1 etc. has lowered. When the door 1 etc. desired to be pulled up from this state, there is no problem when the air compressor 13 is started smoothly, but if an emergency such as a failure of air compressor arises, the compressed air stored in the tank 28 is used.

In this case, after it is checked that the manual shutoff valve 16 is fully opened and the manual shutoff valve 17 is completely closed, the four-way change-over valve 11 is set at the position of (3), and succeedingly the manual shutoff valve 27 is opened. Thereupon, the compressed air flows into the lower air bag 7, by which the door 1 etc. can be raised.

Figure 7:
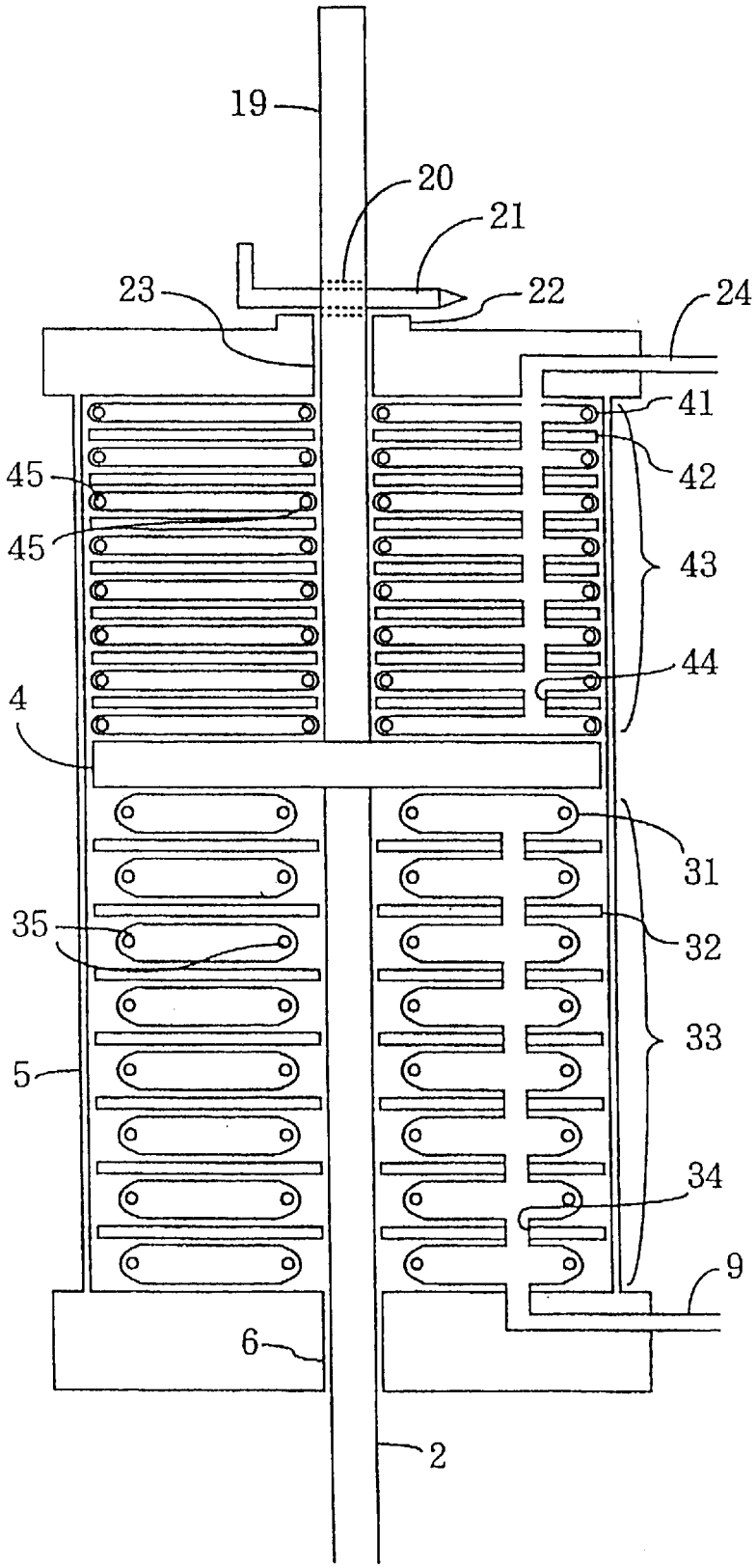
FIG. 7 is a schematic front view showing one example of an air bag used for an apparatus for operating a water gate, showing a construction of a laminated element consisting of shape holding plates and unit bags having a reinforcing rib at the time when a pressure receiving plate moves upward.

FIG. 7 shows another example of air bags that can be used in the apparatus for operating a water gate in accordance with the present invention, showing the same state as that shown in FIGS. 3 and 5. The operating rod 2 for pulling up and pushing down the door of the water gate extends into the case 5 with the upper part thereof being supported by the guide portion 6 at the lower part of the case 5, and is fitted with the pressure receiving plate 4. The operating rod extension 19 is fixed to the upper part of the pressure receiving plate 4, and penetrates the upper part of the case 5 by being supported by the guide portion 23 at the upper part of the case 5.

The operating rod extension 19 is formed with a plurality of pin holes 20. When the pin 21 inserted in this pin hole 20 is supported on a support portion 22 at the upper part of the case 5, the door 1, operating rod 2, pin 3, pressure receiving plate 4, and operation rod extension 19 are prevented from lowering under gravity.

On the lower side of the pressure receiving plate 4 is provided a lower air bag laminated element 33 in which a plurality of unit bags 31 are stacked with shape holding plates 32 being interposed by bonding between the unit bags 31. The unit bags 31 are connected to each other by an air hole 34. A reinforcing rib 35 is provided in each of the unit bags 31 so that each unit bag 31 is always kept in a cylindrical shape. The lower air bag laminated element 33 is connected to the four-way change-over valve through the manual shutoff valve by the air feed pipe 9.

Also, on the upper side of the pressure receiving plate 4 is provided an upper air bag laminated element 43 in which a plurality of unit bags 41 are stacked with shape holding plates 42 being interposed by bonding between the unit bags 41. The unit bags 41 are connected to each other by an air hole 44. A reinforcing rib 45 is provided in each of the unit bags 41 so that each unit bag 41 is always kept in a cylindrical shape. The upper air bag laminated element 43 is connected to the four-way change-over valve by the air feed pipe 24.

In the lower air bag laminated element 33 and the upper air bag laminated element 43, it is preferable that the unit bag 31, 41 and the shape holding plate 32, 42 be bonded to each other with a clearance for allowing expansion of the unit bag 31, 41 being left.

Figure 8:
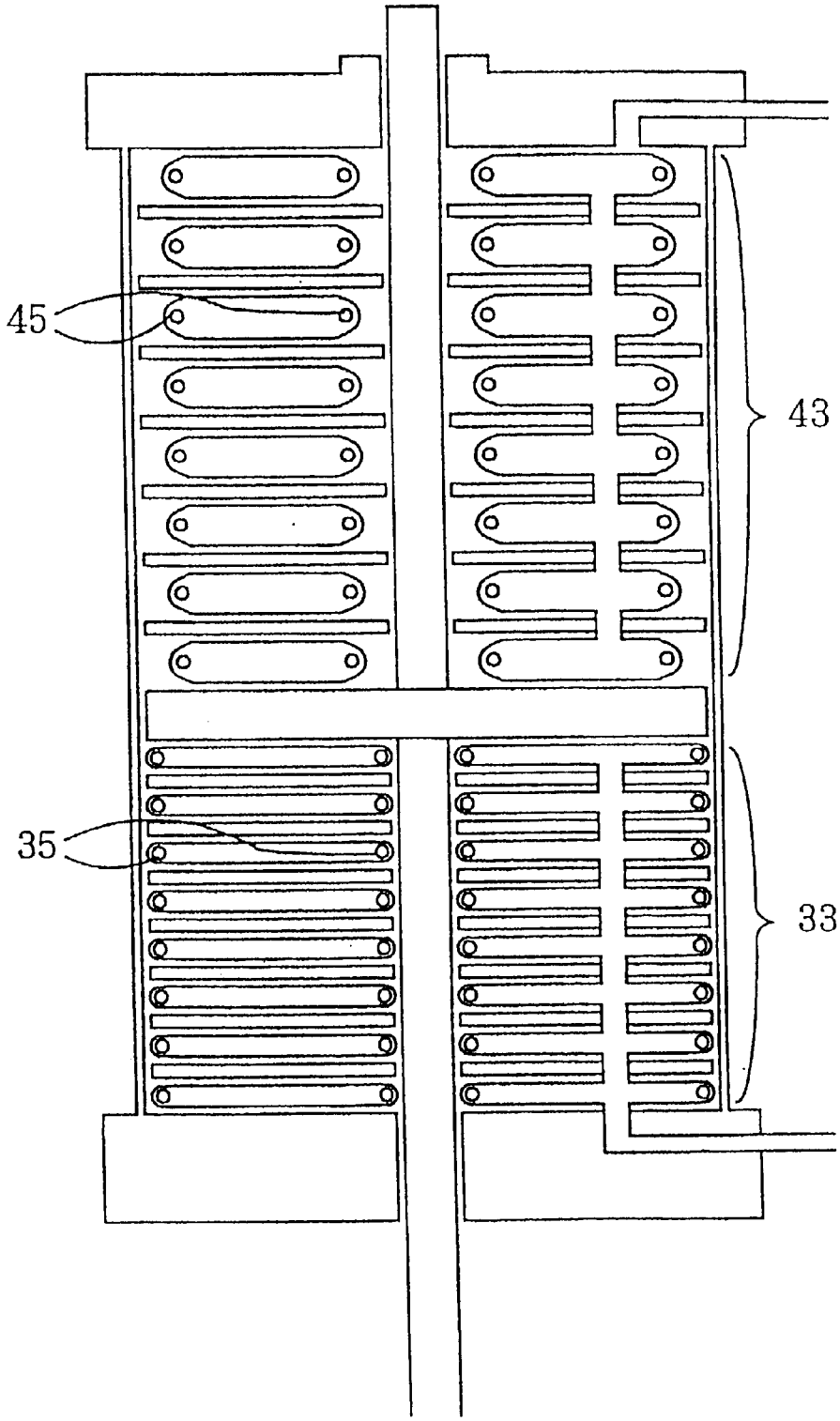
FIG. 8 is a schematic front view of a laminated element consisting of shape holding plates and unit bags having a reinforcing rib at the time when a pressure receiving plate moves downward.

FIG. 8 shows another example of air bags that can be used in the apparatus for operating a water gate in accordance with the present invention, showing the same state as that shown in FIGS. 4 and 6. In this state, the upper air bag laminated element 43 is expanded by the inflow of compressed air, and the lower air bag laminated element 33 is contracted.

Figure 9:
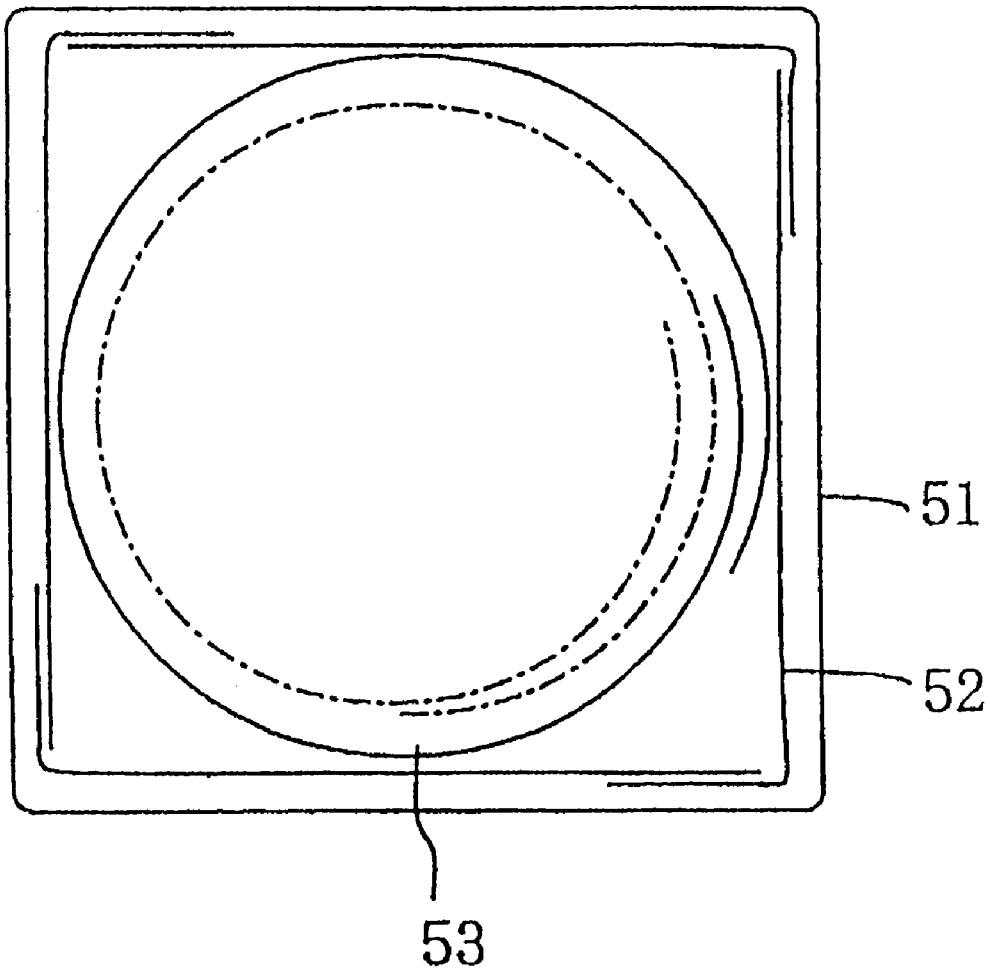
FIG. 9 is a schematic plan view of a unit air bag showing a plane square shape in ground plan, which has a reinforcing rib.

FIG. 9 is a plan view showing an essential part of a unit bag that can be used in the apparatus for operating a water gate in accordance with the present invention. In this example, a unit bag 51 is formed into a square shape. Such a square-shaped unit bag 51 is far easier to manufacture than a circular unit bag when it is manufactured of a rubber coated fabric or the like. Reference numeral 52 denotes a reinforcing rib (outer periphery expanding rib) provided to prevent damage such that the outer periphery side of the unit bag 51 is pulled in and therefore the bonded portion is peeled off when the unit bag 51 comes under a negative pressure so that air is sucked in from the outside. The reinforcing rib 52 is always pushed in the outward direction by a spiral reinforcing rib 53. Therefore, the square shape of the unit bag 51 is maintained. The diameter of the spiral reinforcing rib 53 shortens when the unit bag 51 is expanded, and extends when the unit bag 51 is flattened.

Figure 10:
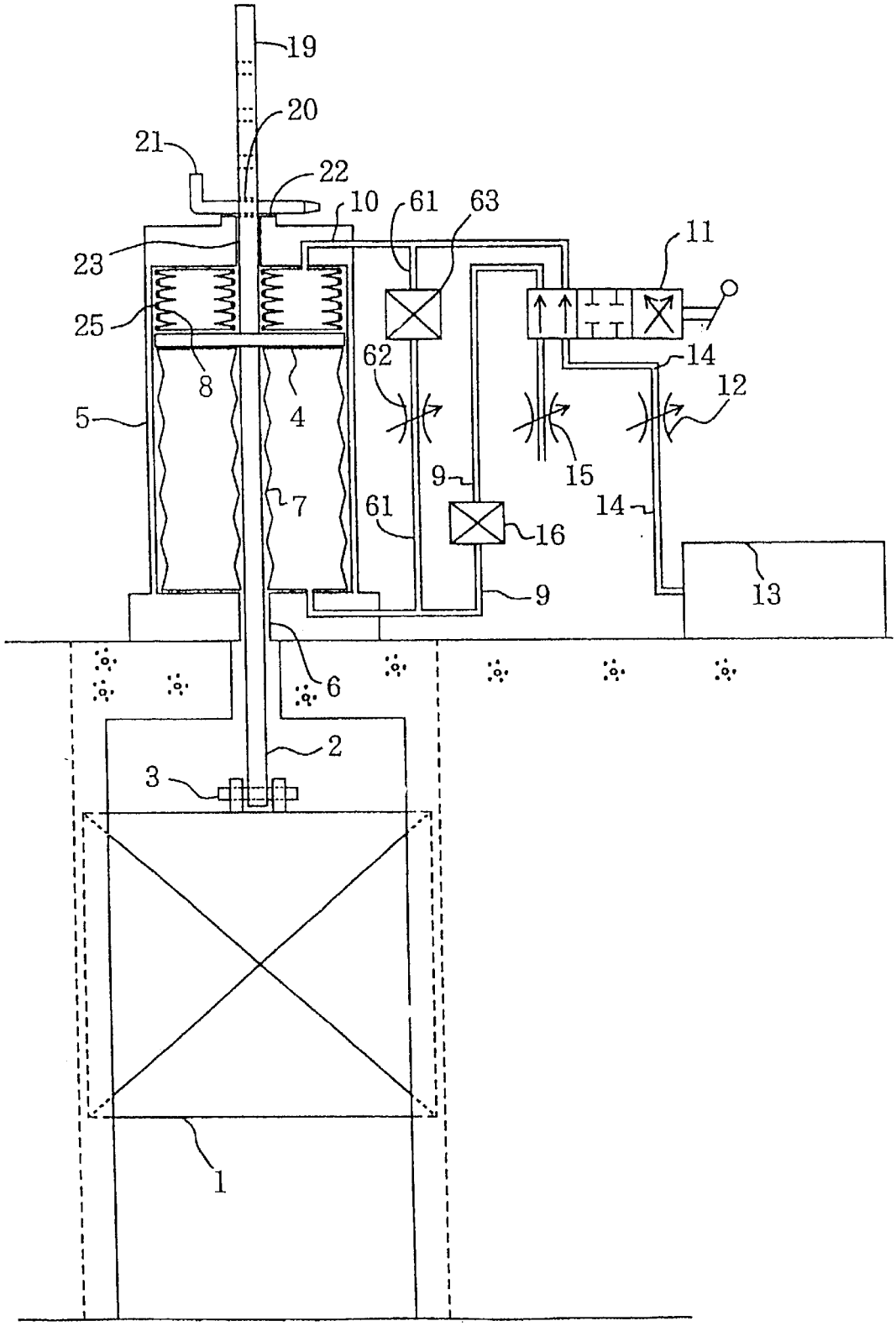
FIG. 10 is a schematic front view showing a fourth embodiment of an apparatus for operating a water gate in accordance with the present invention, the apparatus including a pin for inhibiting the lowering of a door and an operating rod extension having a hole for accommodating the pin, and also including a by-pass pipe which connects upper and lower air bags to each other and has a flow rate regulating valve and a manual shutoff valve at intermediate positions thereof, showing a state in which a door is raised, and the pin is inserted into the hole in the operating rod extension to inhibit the lowering of the door.
Figure 11:
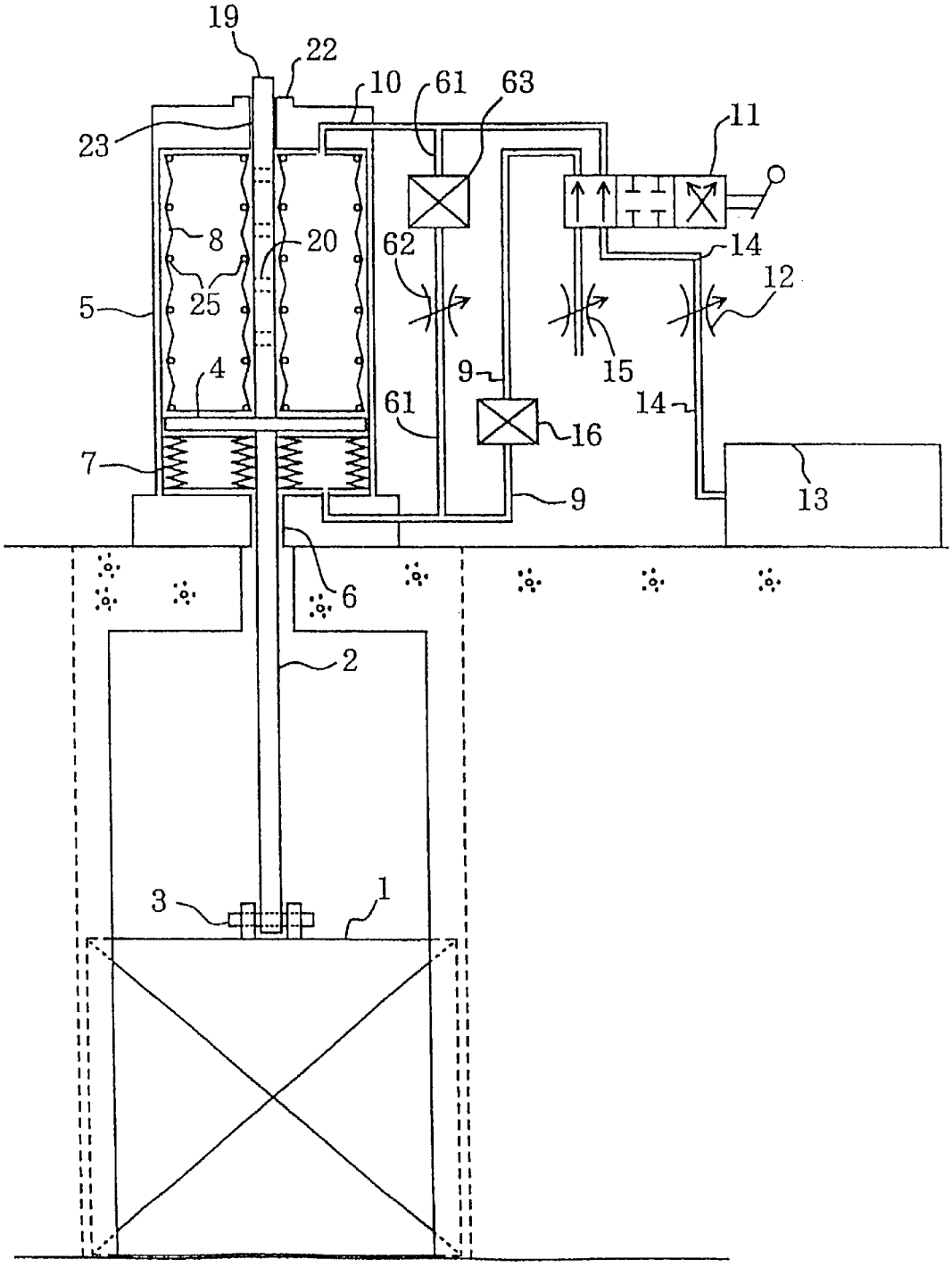
FIG. 11 is a schematic front view showing a state in which the door is lowered by gravity together with the operating rod by pulling out the pin in the embodiment shown in FIG. 10.

FIGS. 10 and 11 show an embodiment in which consideration is given to the lowering of the door under gravity in the apparatus for operating a water gate in accordance with the present invention.

In FIGS. 10 and 11, the operating rod 2 for pulling up and pushing down the door 1 of the water gate is connected to the door 1 by the pin 3. The upper part of the operating rod 2 extends into the case 5 by being supported by the guide portion 6 at the lower part of the case 5, and is fitted with the pressure receiving plate 4. The operating rod extension 19 is fixed to the upper part of the pressure receiving plate 4, and penetrates the upper part of the case 5 by being supported by the guide portion 23 at the upper part of the case 5.

The operating rod extension 19 is formed with a plurality of pin holes 20. When the pin 21 inserted in this pin hole 20 is supported on the support portion 22 at the upper part of the case 5, the door 1, operating rod 2, etc. are prevented from lowering under gravity.

On the lower side of the pressure receiving plate 4 is provided the cylindrical lower air bag 7, which is connected to the four-way change-over valve 11 through the manual shutoff valve 16 by the air feed pipe 9.

On the other hand, on the upper side of the pressure receiving plate 4 is provided a cylindrical upper air bag 8 having a reinforcing rib 25 for keeping the outside and inside diameters thereof, which is connected to the fourway change-over valve 11 by the air feed pipe 10. Further, the air feed pipe 9 is connected to the air feed pipe 10 by a by-pass pipe 61 having a flow rate regulating valve 62 and a manual shutoff valve 63 at intermediate positions.

In addition, at the opposite side of the four-way change-over valve 11, the air compressor 13 is connected through the flow rate regulating valve 12 by the air feed pipe 14, and also the discharging flow rate regulating valve 15 is connected.

If the manual shutoff valve 16 is fully opened and the manual shutoff valve 63 is completely closed in the above-described configuration, the raising, lowering, and stopping operations of the door 1 can be performed by selecting one of the three positions (1) to (3) of the four-way change-over valve 11, as in the case of the embodiment shown in FIGS. 1 and 2.

FIG. 10 shows a state in which compressed air is sent into the lower air bag 7 from the air compressor 13 through the air feed pipe 9 and the manual shutoff valve 16 while the flow rate is regulated by the flow rate regulating valve 12 by setting the four-way change-over valve 11 at the position of (3). At the same time, the air in the upper air bag 8 is discharged into the atmosphere through the air feed pipe 10 while the flow rate is regulated by the discharging flow rate regulating valve 15. As a result, the pressure receiving plate 4 is subjected to a force from the lower air bag 7, by which the pressure receiving plate 4, operating rod extension 19, operating rod 2, pin 3, and door 1 are raised.

Succeedingly, the pin 21 is inserted into one of the pin holes 20 in the operating rod extension 19 so that the pin 21 is supported on the support portion 22 at the upper part of the case 5, by which the lowering of the door 1 etc is inhibited. In this state, therefore, even if air leaks from the lower air bag 7, there is no fear that the door 1 etc. will lower.

FIG. 11 shows a state in which after the pin 21 is pulled out of the pin hole 20 in the operating rod extension 19 so that the door 1 etc. can lower in the state shown in FIG. 10, the door 1 etc. are lowered. In order to lower the door 1 etc. in the state in which the pin 21 is pulled out, a method can be used in which compressed air is sent from the air compressor 13 into the upper air bag 8 by setting the four-way change-over valve 11 at the position of (1). However, the door 1 etc. can be lowered by gravity without using compressed air.

In this case, after the weight of the door 1 etc. is supported by the pressure of air in the lower air bag 7 via the pressure receiving plate 4 by completely closing the manual shutoff valve 16 once, the pin 21 is pulled out of the pin hole 20 in the operating rod extension 19, and succeedingly the manual shutoff valve 63 is opened gently. Thereupon, the door 1 etc. will lower under gravity while the speed thereof is controlled by the flow rate regulating valve 62.

In other words, the air in the lower air bag 7 that supports the weight of the door 1 etc. via the pressure receiving plate 4 moves into the upper air bag 8 through the air feed pipe 9, by-pass pipe 61, and air feed pipe 10 while the flow rate is regulated by the flow rate regulating valve 62. In this case, although the negative pressure in the upper air bag 8 is not so high, there is a fear that the upper air bag 8 will lose its shape. Therefore, the cylindrical shape is maintained by the reinforcing rib 25.

INDUSTRIAL APPLICABILITY

According to the apparatus for operating a water gate in accordance with the present invention, there is provided a new apparatus for operating a water gate, which not only is simple in construction and low in cost so that operation, check, and maintenance, repair, etc. are easy but also has no fear of contaminating the environment. Specifically, the apparatus for operating a water gate in accordance with the present invention has the following features:

(1) Use of Pressure Receiving Plate Having a Large Area

By sufficiently enlarging the area of the pressure receiving plate, the maximum working pressure can be kept low. Therefore, a phenomenon in which the operating rod is stopped or moved by a fluctuation in load is less liable to take place. Furthermore, even if such a phenomenon takes place, sudden movement of the operating rod can be prevented.

(2) Use of Air Bag

If the apparatus uses an air jack or the like, which is formed by a combination of a cylinder, piston, and piston rod which are machined precisely and whose sliding portions move while keeping high airtightness, as before, the apparatus is very expensive as in the case where a hydraulic jack is used. In addition, the frictional force at the sliding portion becomes so high that the apparatus cannot be operated at a low pressure as explained in the above item (1).

To solve this problem, compressed air with a low pressure is sent into an air bag, and the pressure receiving plate covering a large area is pushed by this air bag. Therefore, a sufficient interspace can be afforded to between the pressure receiving plate and the inside surface of a case and between an operating rod and a support portion of the case, so that the frictional force at the sliding portion can be kept very small. Further, members constituting the apparatus, such as the case, pressure receiving plate, and operating rod, are easy to machine, so that the apparatus can be manufactured at a very low cost.

(3) Ease of Providing Function of Lowering Under Gravity

Many small water gates are required to provide a function of lowering the water gate under gravity. To meet this requirement, the conventional apparatus needs a complicated mechanism such as speed control during lowering, which makes the apparatus expensive. In the apparatus for operating a water gate in accordance with the present invention, a function of lowering the gate under gravity can be added at a low additional cost, and the operation for lowering under gravity can be performed easily by operating valves.

(4) Safety From Drop Accident

In the conventional apparatus, if a brake fails, there is danger of a door dropping at a speed approximately equal to the free drop speed. In the apparatus in accordance with the present invention, since the pressure receiving plate with a sufficiently large area is contained in the case, even if an air feed pipe is broken or the air bag punctures, the door will not lower in the state of free drop.

(5) Reliable Emergency Operation by the Use of a Compressed Air Tank

As described in the embodiment, in a water gate requiring emergent operation at the time of a flood etc., compressed air is stored in a tank just in case of air compressor failure. Thus, the reliability of operation can be improved dramatically.

(6) Economical Efficiency and Superiority of Commercially Sold Air Compressor

Various types of air compressors can be used, such as motor driven, engine driven, manual hand driven, and foot pedal driven types. The type is selected according to the condition and circumstance of installation site of the water gate, the size and operation frequency of water gate, and the like. In this case, whichever type is selected, since the air compressor is an industrial product that the manufacturer produces in high volumes by specifying the standard, it has superiority in that not only can it be procured at a low price in short delivery time, but also repair parts etc. can be obtained easily. Furthermore, check, maintenance, and repair can be made easily because specialists in repair etc. are domiciled in every district in Japan.

(7) Safety Due to Disuse of Electricity for Operation

Since the operating system is composed of equipment and pipes for compressed air, safety is ensured because there is no danger of an electric shock accident since the apparatus for operating a water gate must operate even in a rainstorm.

(8) Safety from Contaminated Environment

Safety is ensured because a medium for transmitting a force is air, so that even if it is discharged into the atmosphere, or even if it leaks from the apparatus for operating the water gate, the environment is not contaminated. Also, since the sliding portions excluding equipment for compressed air including the air compressor do not use fat and oil, there is no fear that the leakage of fats and oils contaminates the environment.

What is claimed is:

1. An apparatus for operating a water gate, said apparatus comprising: a door of the water gate provided in a water channel to run and stop water; and an operating mechanism for vertically operating said door, said operating mechanism comprising:

a pressure receiving plate fixed to said door via an operating rod;

a guide portion for guiding the vertical movement of said pressure receiving plate;

an upper air bag and a lower air bag provided on the upper side and lower side of said pressure receiving plate, respectively;

an air compressor for sending air into each of said upper air bag and said lower air bag; and a change-over valve and a flow rate regulating valve provided between said upper air bag and said lower air bag and said air compressor and which are adapted to switch and regulate the air sent into said upper air bag and said lower air bag, wherein compressed air is sent into either of said upper air bag and said lower air bag to move said pressure receiving plate so as to move said door vertically, whereby said door is opened or closed.

2. The apparatus for operating a water gate according to claim 1, wherein each of said upper air bag and said lower air bag provided on the upper and lower sides of said pressure receiving plate consists of a plurality of unit bags, said unit bags are stacked by interposing and bonding a shape holding plate between said unit bags, and said unit bags are connected to each other by an air hole, whereby the shape holding performance of each air bag is improved.

3. The apparatus for operating a water gate according to claim 2, wherein said upper air bag provided on the upper side of said pressure receiving plate is reinforced by a reinforcing rib so that the transverse shape thereof is not deformed greatly by a negative pressure, and a manual valve for suction provided with an air intake portion is connected to said upper air bag through an air feed pipe with a large diameter.

4. The apparatus for operating a water gate according to claim 3, wherein a pin is inserted in said operating rod for connecting said door to said pressure receiving plate such that said pin is supported at a predetermined position of an operating rod guide portion, and said shutoff valve provided in the air feed pipe for said lower air bag is closed to hold said door so as to prevent said door from lowering under gravity, and when said door is to be lowered by gravity, said four-way change-over valve is set at a door lowering position, said pin is pulled out of said operating rod, said manual valve for suction is opened, and then said shutoff valve provided in the air feed pipe for said lower air bag is opened to lower said door by gravity.

5. The apparatus for operating a water gate according to claim 2, wherein said upper air bag provided on the upper side of said pressure receiving plate is reinforced by a reinforcing rib so that the transverse shape thereof is not deformed greatly by a negative pressure, and a manual valve for suction provided with an air intake portion is connected to said upper air bag through an air feed pipe with a large diameter.

6. The apparatus for operating a water gate according to claim 5, wherein a pin is inserted in said operating rod for connecting said door to said pressure receiving plate such that said pin is supported at a predetermined position of an operating rod guide portion, and said shutoff valve provided in the air feed pipe for said lower air bag is closed to hold said door so as to prevent said door from lowering under gravity, and when said door is to be lowered by gravity, said four-way change-over valve is set at a door lowering position, said pin is pulled out of said operating rod, said manual valve for suction is opened, and then said shutoff valve provided in the air feed pipe for said lower air bag is opened to lower said door by gravity.

7. The apparatus for operating a water gate according to claim 2, wherein said upper air bag provided on the upper side of said pressure receiving plate is reinforced by a reinforcing rib so that the transverse shape thereof is not deformed greatly by a negative pressure, and said upper air bag and said lower air bag are connected to each other by a bypass-pipe having a flow rate regulating valve and a shutoff valve at an intermediate position.

8. The apparatus for operating a water gate according to claim 7, wherein a pin is inserted in said operating rod for connecting said door to said pressure receiving plate such that said pin is supported at a predetermined position of an operating rod guide portion, and said shutoff valve provided in the air feed pipe for said lower air bag is closed to hold said door so as to prevent said door from lowering under gravity, and when said door is to be lowered by gravity, said pin is pulled out of said operating rod, and said shutoff valve in said by-pass pipe is opened.

9. The apparatus for operating a water gate according to claim 2, wherein a pin is inserted in said operating rod for connecting said door to said pressure receiving plate such that said pin is supported at a predetermined position of an operating rod guide portion, and said shutoff valve provided in the air feed pipe for said lower air bag is closed to hold said door so as to prevent said door from lowering under gravity, and when said door is to be lowered by gravity, said four-way change-over valve is set at a door lowering position, said pin is pulled out of said operating rod, said manual valve for suction is opened, and then said shutoff valve provided in the air feed pipe for said lower air bag is opened to lower said door by gravity.

10. The apparatus for operating a water gate according to claim 1, wherein the area of said pressure receiving plate is sufficiently large that the pressure of compressed air used is set at about 1 kgf/cm$^2$ or lower, whereby a change in volume of compressed air caused by a change in pressure is made as small as possible.

11. The apparatus for operating a water gate according to claims 1, wherein said air compressor is additionally provided with a tank, and compressed air stored in said tank by said air compressor is used to perform operations in an emergency.

12. An apparatus for operating a water gate, said apparatus comprising:

a door of the water gate provided in a water channel to run and stop water; and an operating mechanism for vertically operating said door, said operating mechanism comprising:

a pressure receiving plate fixed to said door via an operating rod;

a guide portion for guiding the vertical movement of said pressure receiving plate;

an upper air bag and a lower air bag provided on the upper and lower sides of said pressure receiving plate, respectively;

an air compressor for sending air into each of said upper air bag and said lower air bag through an air feed pipe and a flow rate regulating valve;

a discharging flow rate regulating valve for discharging air from said upper air bag and said lower air bag; and a four-way change-over valve provided between said upper air bag and said lower air bag and said air compressor, flow rate regulating valve, and discharging flow rate regulating valve and which is adapted to switch the air sent into said upper air bag and said lower air bag, wherein said four-way change-over valve is adapted to control the opening and closing of said door by:

sending compressed air into said lower air bag by using air from said air compressor by operating to move said pressure receiving plate, whereby said door is raised, sending compressed air into said upper air bag by switching to move said pressure receiving plate, whereby said door is lowered, and being set at a neutral position, and wherein a shutoff valve provided in an air feed pipe for said lower air bag is closed, whereby said door is held at a predetermined position.

13. The apparatus for operating a water gate according to claim 2, wherein said upper air bag provided on the upper side of said pressure receiving plate is reinforced by a reinforcing rib so that the transverse shape thereof is not deformed greatly by a negative pressure, and said upper air bag and said lower air bag are connected to each other by a bypass-pipe having a flow rate regulating valve and a shutoff valve at an intermediate position.

14. The apparatus for operating a water gate according to claim 13, wherein a pin is inserted in said operating rod for connecting said door to said pressure receiving plate such that said pin is supported at a predetermined position of an operating rod guide portion, and said shutoff valve provided in the air feed pipe for said lower air bag is closed to hold said door so as to prevent said door from lowering under gravity, and when said door is to be lowered by gravity, said pin is pulled out of said operating rod, and said shutoff valve in said by-pass pipe is opened.

15. The apparatus for operating a water gate according to claim 12, wherein a pin is inserted in said operating rod for connecting said door to said pressure receiving plate such that said pin is supported at a predetermined position of an operating rod guide portion, and said shutoff valve provided in the air feed pipe for said lower air bag is closed to hold said door so as to prevent said door from lowering under gravity, and when said door is to be lowered by gravity, said four-way change-over valve is set at a door lowering position, said pin is pulled out of said operating rod, said manual valve for suction is opened, and then said shutoff valve provided in the air feed pipe for said lower air bag is opened to lower said door by gravity.

16. The apparatus for operating a water gate according to claim 12, wherein each of said upper air bag and said lower air bag provided on the upper and lower sides of said pressure receiving plate consists of a plurality of unit bags, said unit bags are stacked by interposing and bonding a shape holding plate between said unit bags, and said unit bags are connected to each other by an air hole, whereby the shape holding performance of each air bag is improved.

17. The apparatus for operating a water gate according to claim 16, wherein said upper air bag provided on the upper side of said pressure receiving plate is reinforced by a reinforcing rib so that the transverse shape thereof is not deformed greatly by a negative pressure, and a manual valve for suction provided with an air intake portion is connected to said upper air bag through an air feed pipe with a large diameter.

18. The apparatus for operating a water gate according to claim 16, wherein said upper air bag provided on the upper side of said pressure receiving plate is reinforced by a reinforcing rib so that the transverse shape thereof is not deformed greatly by a negative pressure, and said upper air bag and said lower air bag are connected to each other by a bypass-pipe having a flow rate regulating valve and a shutoff valve at an intermediate position.

19. The apparatus for operating a water gate according to claim 18, wherein a pin is inserted in said operating rod for connecting said door to said pressure receiving plate such that said pin is supported at a predetermined position of an operating rod guide portion, and said shutoff valve provided in the air feed pipe for said lower air bag is closed to hold said door so as to prevent said door from lowering under gravity, and when said door is to be lowered by gravity, said pin is pulled out of said operating rod, and said shutoff valve in said by-pass pipe is opened.

20. The apparatus for operating a water gate according to claim 16, wherein a pin is inserted in said operating rod for connecting said door to said pressure receiving plate such that said pin is supported at a predetermined position of an operating rod guide portion, and said shutoff valve provided in the air feed pipe for said lower air bag is closed to hold said door so as to prevent said door from lowering under gravity, and when said door is to be lowered by gravity, said four-way change-over valve is set at a door lowering position, said pin is pulled out of said operating rod, said manual valve for suction is opened, and then said shutoff valve provided in the air feed pipe for said lower air bag is opened to lower said door by gravity.

21. The apparatus for operating a water gate according to claim 12, wherein the area of said pressure receiving plate is sufficiently large that the pressure of compressed air used is set at about 1 $kgf/cm^2$ or lower, whereby a change in volume of compressed air caused by a change in pressure is made as small as possible.

22. The apparatus for operating a water gate according to claim 12, wherein said air compressor is additionally provided with a tank, and compressed air stored in said tank by said air compressor is used to perform operations in an emergency.

* * * * *